US009522295B2

(12) United States Patent
Annino et al.

(10) Patent No.: US 9,522,295 B2
(45) Date of Patent: Dec. 20, 2016

(54) CROSS-TRAINING FLUTTER-KICK BOOT SYSTEM

(71) Applicants: Zachary Annino, Mystic, CT (US); Matthew Earley, Medfield, MA (US); Joseph Ardagna, Delray Beach, FL (US)

(72) Inventors: Zachary Annino, Mystic, CT (US); Matthew Earley, Medfield, MA (US); Joseph Ardagna, Delray Beach, FL (US)

( * ) Notice: Subject to any disclaimer, the term of this patent is extended or adjusted under 35 U.S.C. 154(b) by 0 days.

(21) Appl. No.: 14/689,978

(22) Filed: Apr. 17, 2015

(65) Prior Publication Data

US 2016/0303417 A1 Oct. 20, 2016

(51) Int. Cl.

| | |
|---|---|
| ***A63B 23/08*** | (2006.01) |
| ***A63B 23/10*** | (2006.01) |
| ***A63B 21/065*** | (2006.01) |

(52) U.S. Cl.

CPC ..... *A63B 21/065* (2013.01); *A63B 21/022* (2015.10); *A63B 23/08* (2013.01); *A63B 23/10* (2013.01)

(58) Field of Classification Search

CPC ... A63B 21/021; A63B 21/022; A63B 21/023; A63B 21/025; A63B 21/05; A63B 21/065; A63B 21/4015; A63B 21/4039; A63B 21/4043; A63B 23/08; A63B 23/10; A63B 25/00; A63B 25/02

See application file for complete search history.

(56) References Cited

U.S. PATENT DOCUMENTS

| | | | | |
|---|---|---|---|---|
| 2,700,832 | A * | 2/1955 | Slovinski | A43B 7/1465 36/132 |
| 3,343,836 | A * | 9/1967 | James, Jr. | A63B 21/065 482/105 |
| 3,901,524 | A * | 8/1975 | Ouellette | A63C 3/00 280/809 |
| 5,169,364 | A | 12/1992 | Donaldson | |
| 5,267,927 | A * | 12/1993 | Catanzano | A63B 21/065 482/105 |
| 5,871,298 | A | 2/1999 | Lekhtman et al. | |
| 7,500,324 | B1 * | 3/2009 | Power | A43B 13/145 36/132 |
| 7,770,930 | B2 | 8/2010 | McLeod | |

* cited by examiner

*Primary Examiner* — Oren Ginsberg
(74) *Attorney, Agent, or Firm* — Melvin K. Silverman

(57) ABSTRACT

A cross-training flutter-kick boot system includes the use of a weighted elongate base having the general geometry of the bottom of the human foot. The base including an elevated central platform located opposite to an arch of the foot. The base also includes two pairs of hollow cylindrical elements, one element of each pair secured at a toe end of the weighted base and the other pair secured at a heel end of the base. A position control assembly (PCA) is securable upon the weighted base and includes respective front and rear hollow cylindrical elements which are securable within respective front and rear pairs of hollow elements by a platform connecting the front and rear I elements. The PCA, when secured to the weighted base, permits a bar having a channel to receive a second bar. An upper portion engages the upper foot and ankle of the user while the bottom surface of the boot includes two bars having respective pairs of parallel longitudinal springs proportioned to provide a spring-resistant movement of the boot portion in front-to-rear directions of movement.

14 Claims, 7 Drawing Sheets

CROSS-TRAINING FLUTTER-KICK BOOT SYSTEM

BACKGROUND OF THE INVENTION

A. Area of Invention

The present invention relates to an exercise device for strengthening the core muscles (made up of abdominal area, lower lumbar, and hips), quads, hamstrings, and glute area of cross-training athletes.

B. Prior Art

In recent years, cross-training has developed as a stand-alone area of competition and physical fitness. Therein, the aim of cross-training is to afford a broad, general and inclusive regime of fitness and then to prepare a trainee for particular physical contingencies and unknown situations. In cross-training, particular physical tasks and areas of training have developed as physical skills and adaptations thereof that facilitate enhanced performance and competitive advantage within the philosophy and objectives of cross-training. Cross-training has been defined as a physical regimen which optimizes fitness through conditions of varied functional movements which are performed at a relatively high intensity. It has evolved through a communal network which includes accredited trainers, workouts, competition, and foundations to further the methodology thereof. A cross-training regimen is one of constantly varied, functional movement and intensity undertaken together with other like-minded athletes.

Many of the demands requisite of cross-training of necessity create intersections with areas of fitness that are general to many sports. As such, a number of the areas of focus of this style of training have proven to be of interest to athletes concerned with various specific sports.

In cross-training, as is the case in many areas, strength, flexibility and durability of the ankles, lower leg and knee are paramount. Standalone exercise boots have appeared only rarely in the prior art, this as opposed to the incorporation thereof into a larger piece of exercise equipment. Such exercise boots which are known to exist in the art are U.S. Pat. No. 5,169,364 (1992) to Donaldson, entitled Weight Attachable Leg Exercise Device; U.S. Pat. No. 5,871,298 (1999) to Lekhtman, entitled Exercise Boot; and U.S. Pat. No. 7,770,930 (2010) to McLeod, entitled Exercise Weight For Ice Skates.

SUMMARY OF THE INVENTION

The present cross-training flutter-kick training system includes the use of a weighted elongate base having the general geometry of the bottom surface of the human foot, in which said base includes an elevated central platform located generally opposite to an arch of the foot when the system is in use. The base also includes two pairs of hollow cylindrical elements, one element of each pair secured at a toe side of the weighted base and the other such pair secured at a heel end of said elongate base. Also provided is a position control assembly (PCA) which is selectably securable upon said weighted base and includes respective front and rear hollow cylindrical elements which are securable within respective front and rear axially disposed pairs of hollow cylindrical elements by a central platform connecting said front and rear elements of said PCA. A weight having a longitudinal channel therein is secured upon said central platform. Said PCA, when secured by bolts to said weighted base, permits said weight to receive a longitudinal bar of substantially like cross-section.

An upper portion of the system engages the foot and ankle of the user while a bottom surface thereof includes two pairs of parallel longitudinal springs proportioned to limit a reciprocal movement of the boot portion in front-to-rear directions. The boot, as herein described, is secured to said longitudinal weight of the PCA by said longitudinal bar such that the PCA and the weighted elongate base may be readily connected to the upper part of the system by attachment to said longitudinal bar. Said bar is securable to said projecting weight through the use of a plurality of said screws or like means. Said two pairs of parallel longitudinal springs are held upon a corresponding pair of longitudinal bars secured to the anterior and interior sides of the bottom of the boot or foot-securing portion of the system. Weighted base 10 may be provided in a range of weights such as 5, 10, 15, 20, 25 pounds and higher.

Through the above arrangement, the mass or weight of the weighted base of the system and said pair of springs may be readily changed to suit the needs and capabilities of a particular cross-trainer while protecting the athlete from extremes of movement of the lower parts of the system relative to the boot portion by the properties of said springs which control the front-to-rear motion of the lower parts of the system relative to the boot portion thereof.

It is accordingly an object of the present invention to provide a system for training of the lower leg and core of the athlete, particularly in regard to flutter-kick movements.

It is another object to provide a system for the strengthening of the interface between the fibula and tibia, on the one hand, and subtalor joint of the foot on the other hand.

It is a further object of the invention to provide a cross-training device for strengthening the muscles and tendons associated with the fibula and tibia of the lower leg of an athlete.

It is another object to provide a system of the above type in which the weight or resistance thereof may be readily varied by simply changing selectable element thereof.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
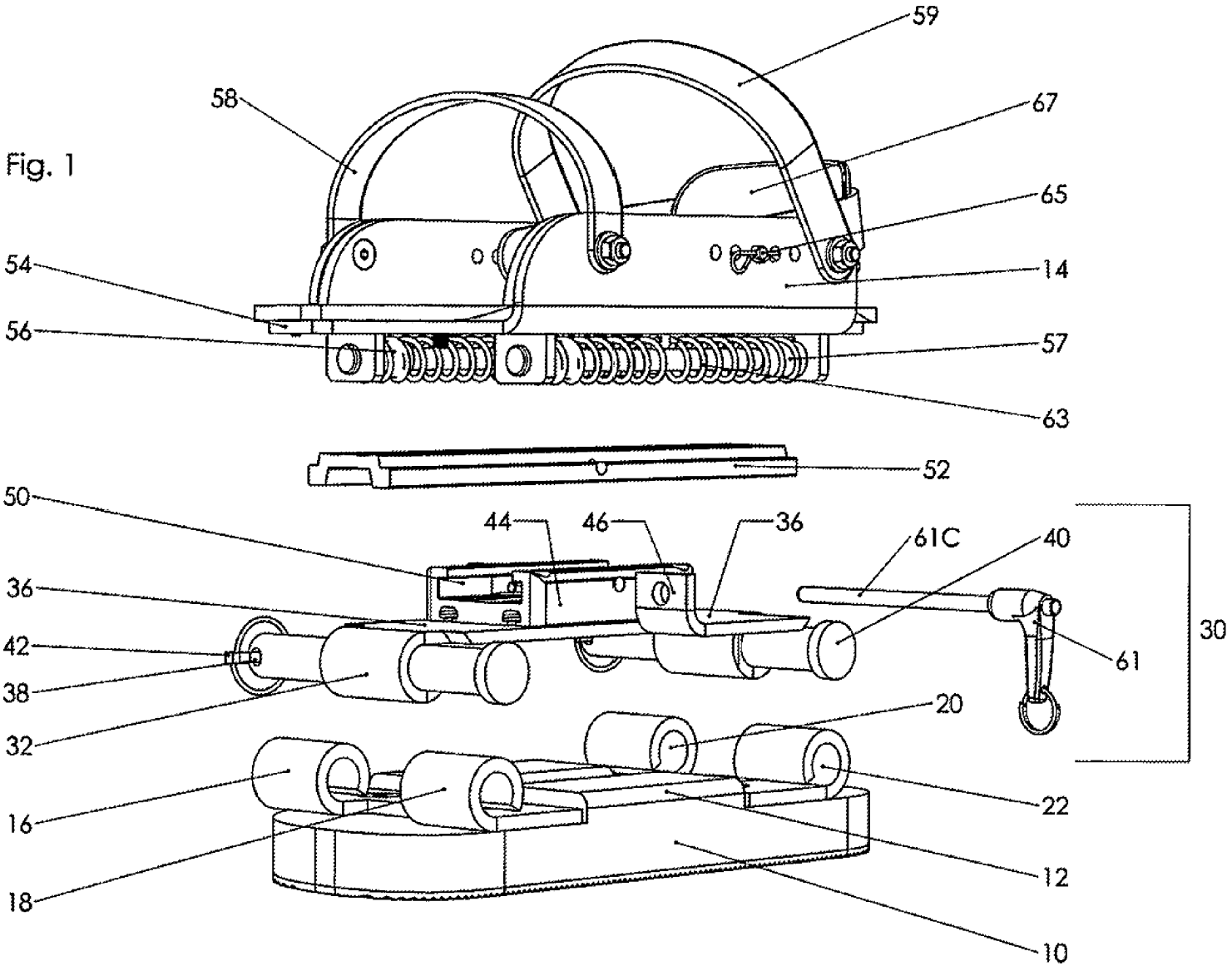
FIG. 1 is a side perspective exploded view of the inventive boot.

With reference to FIG. 1, there is shown an exploded view which includes all basic components of the inventive flutter-kick or lower and upper leg exercise boot. More particularly, shown at the bottom of FIG. 1 is a weighted elongate base 10 having a general geometry of the bottom of a human foot. Said weight base 10 is characterized by a slightly elevated central platform 12 which, when the system is in use, projects in the direction of the arch of the foot when beat boot portion 14 is secured to central U-shaped weight 44 of the system. The elongate base 10 also includes two pairs of hollow cylindrical elements, namely, a first pair 16/18 and a second pair 20/22. As may be noted, each of the elements of the first pair of hollow cylindrical elements are positioned transversely across from each other but are separated from each other by a distance generally related to the width of each element. The same is the case with second element pair 20/22. As may be noted in FIGS. 1-3, each cylindrical element pair 16/18 and 20/22 preferably depend from respective base plates 24 and 26 which are secured to the weighted base 10 by said screws 28. (See FIG. 2).

Above platform 12 and the pairs of cylindrical elements is a position control assembly (PCA) 30 from which depend axially disposed cylindrical elements 32 and 34 from the respective forward and rear ends platform 36 of PCA 30. As may be appreciated in the exploded views of FIGS. 2 and 3, weighted base 10 and associated elements are secured to PCA 30 through the use of cylinders 38 and 40. In other words, by the insertion of belt cylinder 38 into loops 18, 32 and 16, of the front portion of PCA 30, and the insertion of cylinder 40 through loops 22, 34 and 20 accomplishes the securement of the heel portion of the PCA and its platform 36 to system base 10. Lynch pin 42 or the like may be used to establish the position of the cylinders within their respective groups of hollow cylindrical elements. The PCA 30 is also characterized by said centrally disposed u-shaped weight 44 secured on platform 36 by vertical element 46 which is an integral extension of platform 36 and by screws 48 (see FIGS. 1 and 2A). Weight 44 is characterized by a longitudinal channel 50, the cross-section of which is complemental to the exterior of longitudinal bar 52 which, resultantly, is slidable within channel 50. This slidable relationship is significant in terms of the functionality of the present system in that, as may be noted in FIGS. 2A-3, when longitudinal bar 52 is secured to the bottom 54 (FIGS. 2 and 4) of boot portion 14, the entire boot portion is able to slide upon bar 53 in channel 50. See FIG. 5. Therein, the range of motion of weight 44 relative to the boot portion 14 is controlled by resilient stops 56 and 57 but modulated by the spring constant and spring rate of springs 63 which surround rods 64 both of which rods end in stops 56/57 at the inner and outer sides of the boot.

Figure 2:
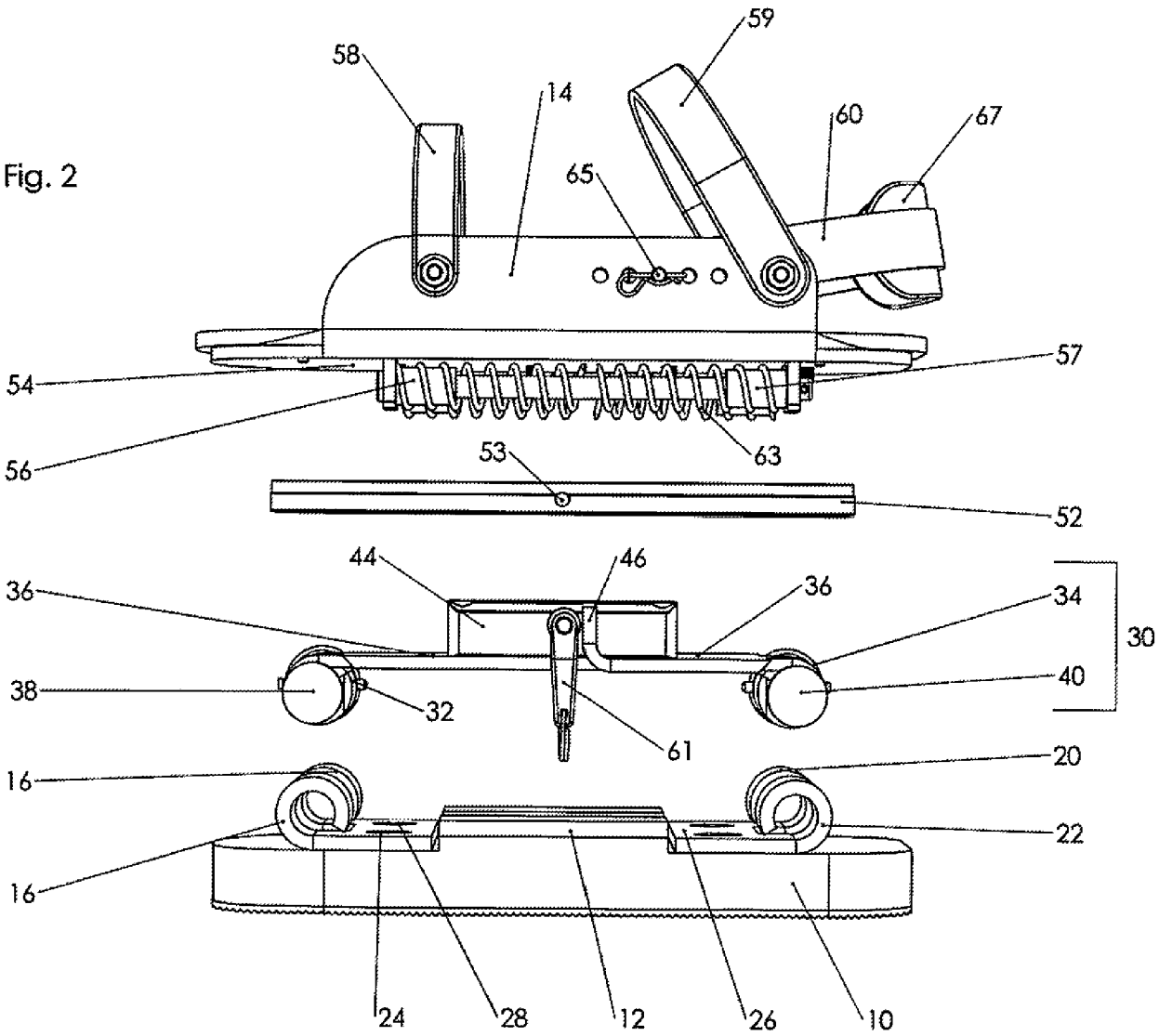
FIG. 2 is a side view of the exploded view of FIG. 1.
Figure 2A:
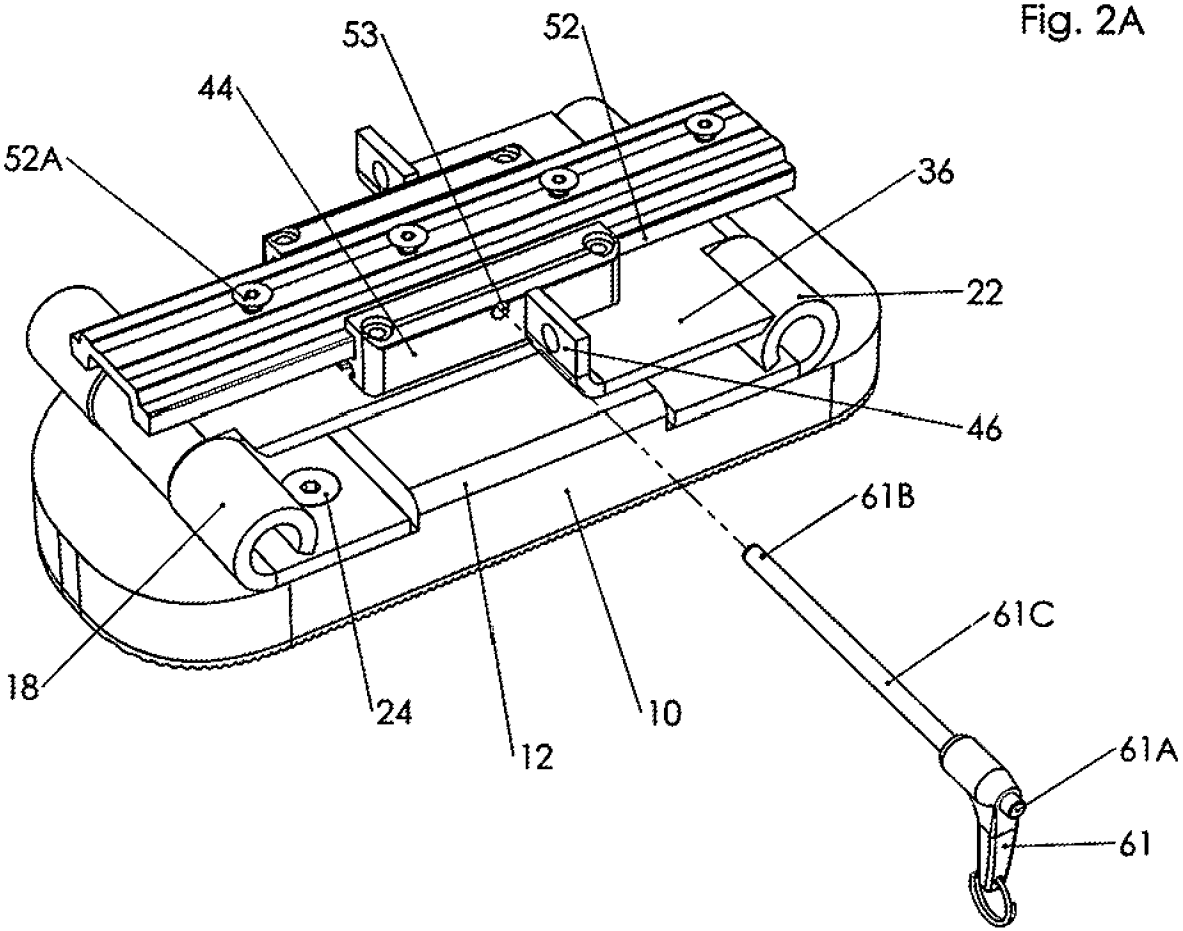
FIG. 2A is an assembly view of the position control assembly (PCA) and the weighted base of the system.
Figure 3:
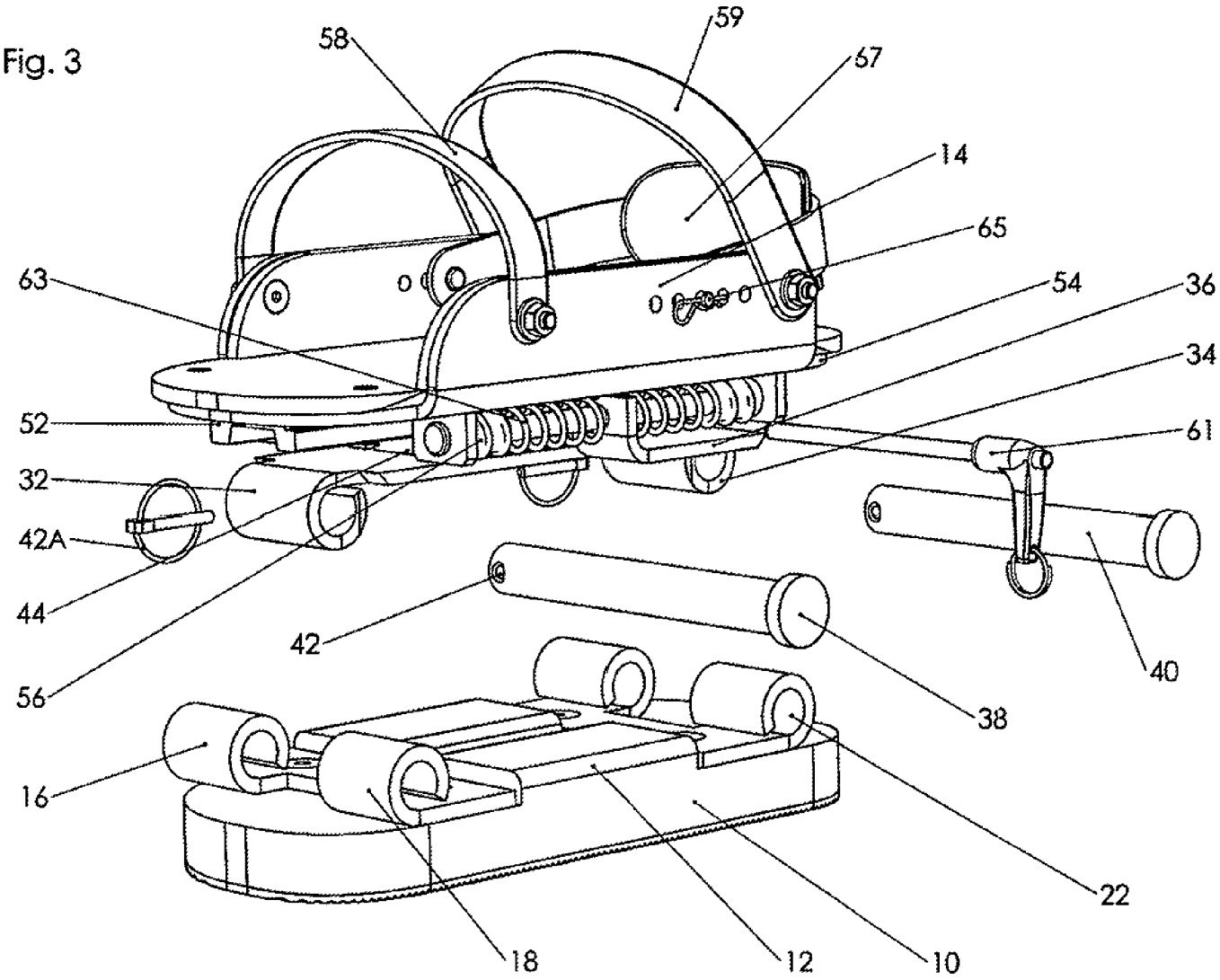
FIG. 3 is a partial assembly view, similar in direction to that of FIG. 1, however showing the control assembly of the system secured to the bottom of the boot portion thereof.
Figure 4:
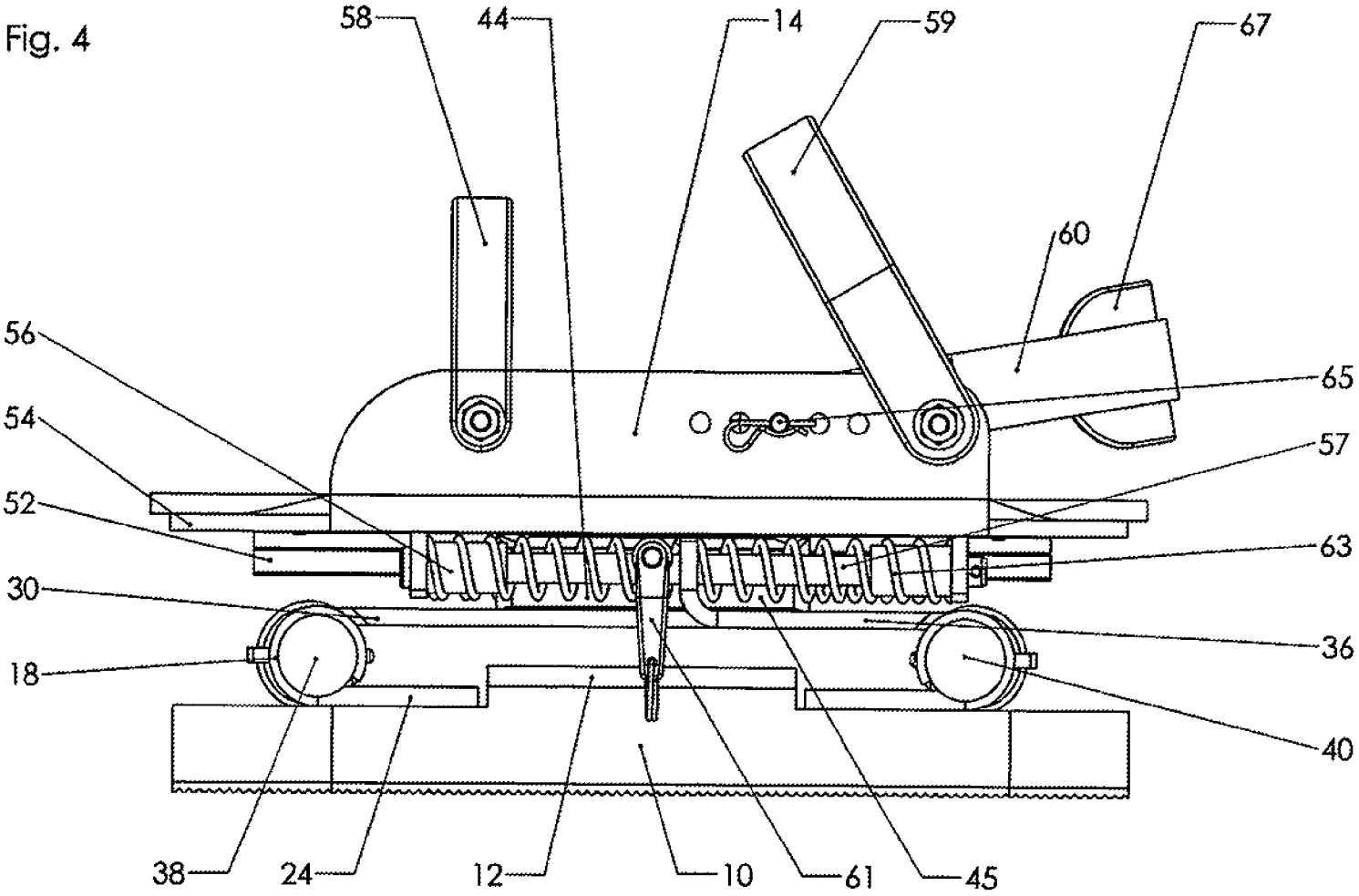
FIG. 4 is an assembly view of the entire exercise device.

The resulting range of motion and spring resistance may be more fully appreciated with reference to FIGS. 2 and 4 wherein the relationship of the springs pairs 63 relative to rods 52, the PCA 30 and base 12 may be appreciated. In FIGS. 2, 3 and 4, the boot portion 14 as well as its associated straps 58/59/60 are shown relative to central weight 44 and PCA 30. As such, the position of weight 44 relative to the springs 63 control the location of the bar 52 when locked to weight 44 by bayonet bolt 61 and its elements button 61A, shaft 61C and extension element 61B (see FIGS. 2A and 4).

A flutter step motion in alignment with the gravity vector during exercise segments moves forwardly of the center of gravity of the weighted base 10 upon downstrokes. The illustrated position of springs 63 in FIG. 4 would correspond to a neutral portion of a leg curl or flutter kick. However motion, whether with or against the gravity vector, is cushioned by the effect of springs 63 upon bars 46 and boot portion 14. Stops 56/57 also act to prevent the bottoming-out of springs 63 during vigorous exercise and to stabilize the outer ends of springs 63. The selection of the position of weight 44 determines its distance between the inner ends of the springs 63 and the resilient stops 56 and 57 which affect is significant to control the upper and downward momentum during use of the system and during reversals of upper and lower directions of a flutter-kick. Therein if such distance is too great, the potential of injury to the ankle or knee of the user is increased since the difference between upward and downward momentum of the system is increased. Therefore, the use of resilient stops 56 and 57 reduce the rate of springs 63 of the boot portion and, as such, function to reduce the possibility of injury to the user. It is noted that the weighted base 10 may be selected in accordance with a level of weight that the user of the system is comfortable with.

It is noted that vertical elements 46 of platform 36 function to separate each pair of discrete springs 63 at about the location of bore 53 of elongate rod 52 and of bayonet bolt 61. (See FIGS. 2, 4 and 5).

Figure 5:
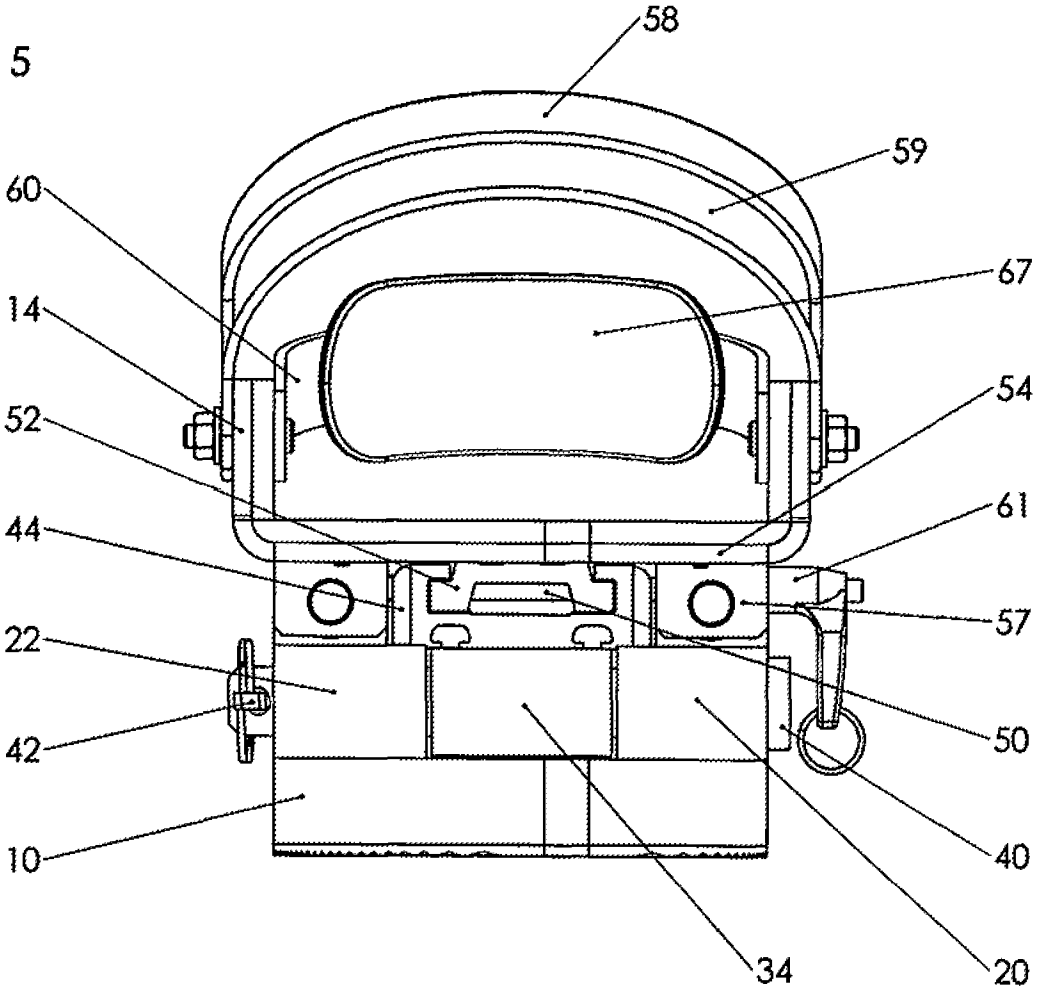
FIG. 5 is a rear elevational view of the assembly device shown in FIG. 4.
Figure 6:
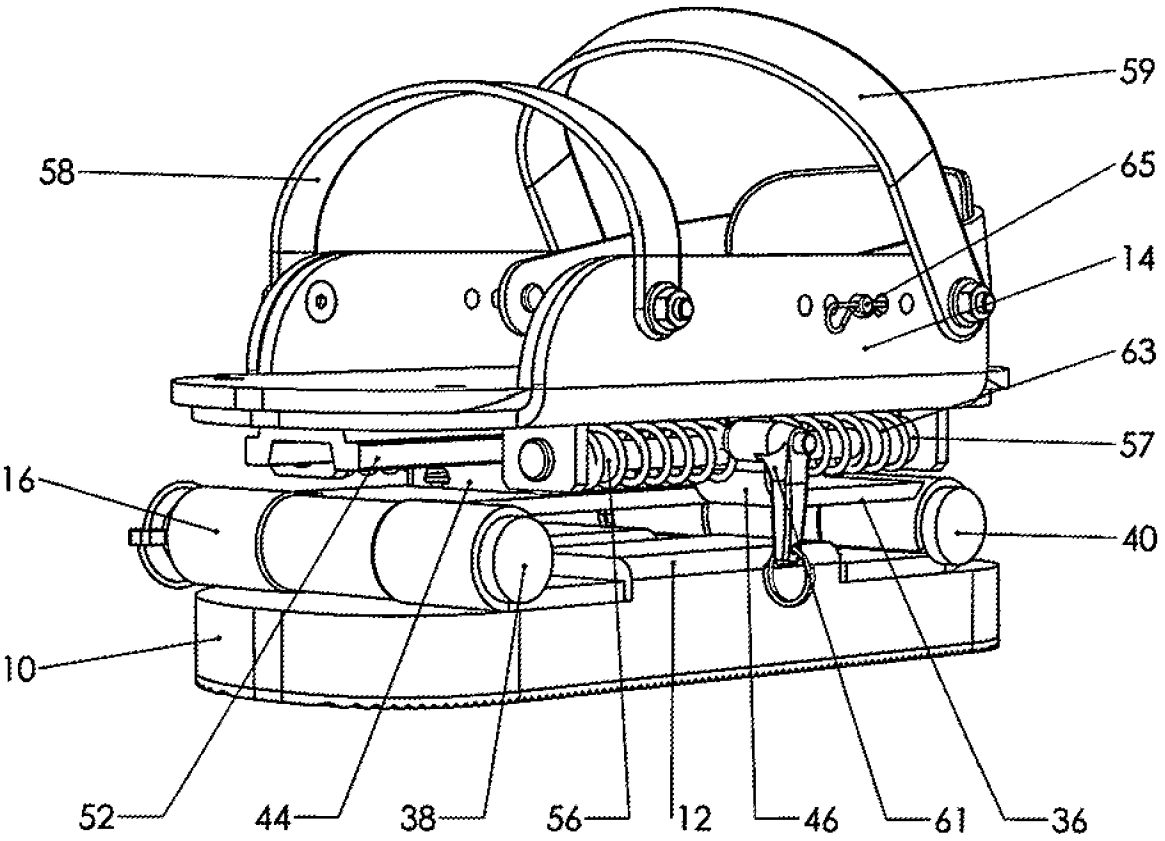
FIG. 6 is a perspective elevational assembly view of the assembled exercise device.

Shown in FIG. 5 is a rear view of the illustration of FIG. 4, in which may be seen the relationship between longitudinal bar 52 and its complemental channel 50 within weighted element 44. FIG. 6 is an assembly view of the complete flutter-kick or lower and upper leg exercise boot when fully assembled.

FIGS. 4 and 6 show the adjustability of the heel adjustment strap 60 and the heel pad 67, using clevis pin 65. The forward and rear foot straps 58 and 59, are adjustable to permit tightening snugly against the athlete's sneaker.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

We claim:

1. In a flutter-kick training assembly including a weighted elongate base having the general geometry of a bottom surface of a human foot, in which the base includes an upper platform located generally opposite to an arch of the foot, the base also including front and rear means for limiting a range of longitudinal movement of the base relative to the platform, a flutter-kick training system comprising:

(a) a longitudinal position control assembly (PCA) securable upon said weighted base and including respective front and rear elements securable relative to said front and rear limit means, said respective elements dependent upon respective ends of a central platform having therein a longitudinal channel, said elements proportioned to complementally receive a longitudinal bar, selectably positionable within said channel; and (b) a boot portion above said PCA, said longitudinal bar engaging a bottom surface of said boot portion in which the bottom surface thereof includes a longitudinal rod and having respective detents proportioned to control and limit movement of springs associated with said rod of the boot portion in front-to-rear directions.

2. The system as recited in claim 1, further comprising: anatomically adjustable foot and heel supports within said boot portion for firmly engaging the foot and heel of a user.

3. The system as recited in claim 1, further comprising: means for selectably locking said longitudinal bar within a central weight of said central platform of said PCA.

4. The system as recited in claim 1, said longitudinal rod comprising a pair of parallel longitudinal rods secured at respective interior and anterior sides of said bottom surface of the boot portion.

5. The system as recited in claim 4, comprising means for securing a central weight of said PCA within said spring-associated rods of said boot portion.

6. The system as recited in claim 1, in which said front and rear means for limiting the range of movement of said central platform comprises:

two pairs of resilient means, one of each pair at a respective toe and heel ends of said base.

7. The system as recited in claim 6, in which each of said resilient means comprise:

loop springs.

8. The system as recited in claim 4, further comprising:

means for selectably locking said longitudinal bar within a central weight of said PCA.

9. The system as recited in claim 3, said longitudinal rod comprising a pair of parallel longitudinal rods secured at respective interior and anterior sides of said bottom surface of the boot portion.

10. The system as recited in claim 9, comprising means for securing said central weight of said PCA within said spring-associated rods of said boot portion.

11. A flutter-kick training system, comprising:

(a) a weighted elongate base having the general geometry of a bottom surface of a human foot, in which said base includes an upper platform located generally opposite to an arch of a foot, said base also including front and rear means for limiting a range of longitudinal movement of said base;

(b) a longitudinal position control assembly (PCA) securable upon said weighted base and including respective front and rear elements securable relative to said front and rear limit means, said respective elements dependent upon respective ends of a central platform having therein a longitudinal channel, said elements proportioned to complementally receive a longitudinal bar, selectably positionable within said channel; and (c) a boot portion above said PCA, said longitudinal bar engaging a bottom surface of said boot portion in which the bottom surface thereof includes a longitudinal rod and having respective detents proportioned to control and limit movement of springs associated with said rod of the boot portion in front-to-rear directions.

12. The system as recited in claim 11, further comprising:

means for selectably locking said longitudinal bar within a central weight of said central platform of said PCA.

13. The system as recited in claim 12, said longitudinal rod comprising a pair of parallel longitudinal rods secured at respective interior and anterior sides of said bottom surface of the boot portion.

14. The system as recited in claim 13, comprising means for securing said central weight of said PCA within said spring-associated rods of said boot portion.

* * * * *